US008827189B2

(12) United States Patent
Vanagosoom

(10) Patent No.: US 8,827,189 B2
(45) Date of Patent: Sep. 9, 2014

(54) ACTUATOR

(75) Inventor: Ekapote Vanagosoom, Bangkok (TH)

(73) Assignee: Southrim Limited, Kaiapoi (NZ)

( * ) Notice: Subject to any disclaimer, the term of this patent is extended or adjusted under 35 U.S.C. 154(b) by 1334 days.

(21) Appl. No.: 12/531,298

(22) PCT Filed: Mar. 12, 2008

(86) PCT No.: PCT/NZ2008/000050

§ 371 (c)(1),
(2), (4) Date: Mar. 1, 2010

(87) PCT Pub. No.: WO2008/111859

PCT Pub. Date: Sep. 18, 2008

(65) Prior Publication Data

US 2010/0147978 A1 Jun. 17, 2010

(30) Foreign Application Priority Data

Mar. 14, 2007 (NZ) ..... 553838

(51) Int. Cl.
*B05B 15/08* (2006.01)

(52) U.S. Cl.
USPC ..... 239/587.2; 239/587.1; 239/280; 169/24; 169/25; 169/52; 285/147.1; 285/181; 285/920

(58) Field of Classification Search
CPC ..... B05B 15/066; B05B 15/067; B05B 1/14; B05B 15/061; A62C 27/00; A62C 31/05; A62C 3/00; A62C 3/0292; F16L 27/0861; F16L 27/0849; F16L 27/0845; F16L 27/00; F16L 37/002; F16L 37/62
USPC ..... 239/587.1, 587.2, 280, 280.5; 169/24, 169/25, 51, 52, 54, 62; 285/181, 147.1, 285/147.3, 920
See application file for complete search history.

(56) References Cited

U.S. PATENT DOCUMENTS

| | | | | |
|---|---|---|---|---|
| 557,799 | A | 4/1896 | Gorter | |
| 2,986,344 | A * | 5/1961 | Knight | 239/587.2 |
| 3,575,060 | A | 4/1971 | Warren | |
| 3,575,351 | A * | 4/1971 | Warren | 239/227 |
| 3,583,637 | A * | 6/1971 | Miscovich | 239/203 |
| 4,274,329 | A * | 6/1981 | Weyer | 92/33 |
| 5,016,836 | A | 5/1991 | Thouron | |
| 5,063,816 | A * | 11/1991 | Soga et al. | 477/39 |
| 6,019,771 | A | 2/2000 | Bennett et al. | |
| 6,305,620 | B1 | 10/2001 | Marchese | |
| 6,640,689 | B2 | 11/2003 | Mitsui et al. | |

(Continued)

FOREIGN PATENT DOCUMENTS

| | | |
|---|---|---|
| GB | 2260901 | 5/1993 |
| JP | 10234879 | 9/1998 |

OTHER PUBLICATIONS

International Search Report, PCT/NZ2008/000050, 3 pages, Jun. 25, 2008.

*Primary Examiner* — Steven J Ganey
(74) *Attorney, Agent, or Firm* — Polsinelli PC

(57) ABSTRACT

The invention provides an actuator apparatus which may be used to adjust flow of fluid or air in conjunction with a rack and pinion system. The device is able to rotate both vertically and horizontally via a mechanism that transforms axial movement into rotary movement. The device is useful in a range of circumstances where required specific and controllable rotary motion is required.

23 Claims, 12 Drawing Sheets

(56) References Cited

U.S. PATENT DOCUMENTS 6,755,703 B1 * 6/2004 Erickson ..... 440/75
6,994,282 B2 * 2/2006 Trapp et al. ..... 239/587.2
7,137,578 B2 11/2006 Steingass et al.
7,191,964 B2 * 3/2007 Trapp ..... 239/587.2
2003/0041598 A1 3/2003 Takeuchi et al.

* cited by examiner

ACTUATOR

CROSS-REFERENCE TO RELATED APPLICATIONS

This application is the national stage application of PCT Application No. PCT/NZ2008/000050, filed Mar. 12, 2008 and entitled "Actuator;" and claims under 35 U.S.C. §365(b) priority to New Zealand Application No. 553838, filed on Mar. 14, 2007 and entitled "Actuator."

FIELD OF THE INVENTION

The invention relates to an actuator that uses an adjustable flow hydraulic or pneumatic cylinder operating through a rack and pinion. This in turn, powers devices such as cannons (sometimes known as monitors), more preferably fluid cannons.

BACKGROUND

A liquid cannon is normally a tubular device which can be rotated both horizontally and vertically to control the direction of water flow from a nozzle. In operation, one end of the device is connected to a ground sourced water supply or mobile tank. The other end of the device terminates in a nozzle, which is used to project the fluid out of the liquid monitor in a desired direction, speed and volume. The liquid supply is typically under a pressure, thereby inducing a forceful projection of fluid out of the nozzle of the liquid cannon.

A liquid cannon can typically be articulated, such that the direction of fluid projection may be changed about both a vertical axis and horizontal plane, to enable the projection of water to be aimed in different directions. A liquid cannon is used by its operator to project a volume of fluid onto or into a variety of locations for dust suppression, fire fighting or surface cleaning. Many liquid cannons are attached directly to a vehicle, such as a water truck.

Known cannons have a number of disadvantages.

Many lack simplicity of design. The system often needs to be repaired by semi skilled personnel working in remote locations which have poor engineering support. This also extends to the power mechanism for any rotational movement. The fewer motors and pumps the vehicle has the less likely they will be to break down and the easier they will be to maintain and keep operational. Simplicity is also a key to operational adjustments or changes. The unit needs not only to be easy to maintain but also easy to adjust should any performance changes be required i.e. rotational movement speed increased or reduced. It also needs to be tolerant of harsh environments and vibration, both of which are very common in off road situations.

Cannons may require remote activation by an operator. This allows the cannon to be located in the best position relative to the destination for the liquid but at the same time gives flexibility for the operator to be wherever he/she needs to be. In the case of a water truck the operator is located in the cab driving the vehicle so the cannon needs to be operated from this location.

The control mechanisms need to be unaffected by the presence of liquids and water in particular. Electronic actuating mechanisms are therefore less desirable as they have a tendency to corrosion and short circuits when water is present.

The pressure with which fluid is forced from the nozzle places significant stress on any rotating actions (moving parts controlling slew and elevation need to be robust). Many previous rotating mechanisms had a very short service life due to their actuating mechanism design and fabrication.

Cannons need to be economic to manufacture. The nature of water truck operations especially requires a cannon to be economic to produce and supply to the industry.

Known liquid cannons do not provide these features and there is therefore a need for an improved actuating mechanism that provides the public with a more reliable system.

OBJECT OF THE INVENTION

It is an object of the invention to provide an actuating mechanism for a cannon that has advantages over known systems or which will at least provide the public with a useful choice.

SUMMARY OF THE INVENTION

The invention provides a pneumatic or hydraulically powered actuator apparatus which is adapted for cannon type applications wherein, the required rotary motion in the actuator apparatus is transmitted to the cannon type application via a rack and pinion mechanism, in conjunction with a cylinder and reduction set.

Specifically the invention provides an actuator apparatus adapted for a cannon type application delivering required rotary motion at the actuator apparatus output, and wherein the drive train of the apparatus transforms axial movement into rotary movement.

Specifically the invention provides an actuator apparatus comprising a rack and pinion mechanism in combination with a cylinder and reduction gear set. The drive train transforms axial movement into rotary movement.

The cylinder and reduction gear set is preferably made from corrosion resistant stainless steel and brass components.

Preferably the actuator includes an integral adjustable flow control valve (needle valve) which allows for a simple and easy flow adjustment controlling speed and "feel".

In the case of a fluid cannon, the cannon's base may be held onto a fixed surface and a tubular body rotates horizontally on this base. The tubular body then preferably bends 180 degrees and affixes to another tubular body which rotates vertically to aim the fluid where it is to be sprayed.

The vertical and horizontal rotations are preferably powered either hydraulically or pneumatically via adjustable flow cylinders through the use of the rack and pinion and gear set.

The cylinders may be remotely controlled by a human operator moving an electronic joystick which actuates solenoid valves to direct oil or air to rams to provide the required rotational movement.

The rotational movement may be provided via electric over air or electric over hydraulic.

The invention also provides an actuator apparatus comprising:

(a) a horizontal drive apparatus operatively engaged with a rotatable body, the horizontal drive apparatus being operable to rotate the rotatable body in response to control signals;

(b) a vertical drive apparatus operatively engaged with a discharge elbow, the vertical drive apparatus being operably able to rotate said discharge elbow in response to control signals.

This provides a 360 degree movement of a cannon for precisely directed fluid flow. Both the horizontal and vertical drive apparatus form the basis of the invention and use a rack and pinion mechanism in conjunction with a gear set. This drive train transforms the axial movement of the pistons into a rotary movement required to operate the cannon. The piston actuates in the desired direction when a joystick activates the relevant solenoid and air or fluid is directed to the desired end of the cylinder. The piston moves axially and this movement is transferred via a rack and pinion to rotate the pinion. The rack preferably forms part of the cylinder piston shaft. This rotary movement of the pinion is further geared down using a gear set comprising of one smaller gear (driver) attached to the end of the pinion and one larger gear (driven) attached to the portion of the cannon which is to be rotated. The speed transmitted by the rack and pinion and gear set may be adjusted by changing the teeth on the rack and pinion or gear sets and the hydraulic or pneumatic force may also be changed by altering the piston size.

Preferably the actuator comprises a series of electric over air or oil (dependant on whether the system is pneumatic or hydraulic) solenoids which control the piston's movement and receive their instructions from an electronic joystick which is controlled by the machine operator. Each rotating member (one vertical [elevation] and one horizontal [slew]) may be controlled by an individual cylinder, and these in turn may be controlled by the joystick's movement and the resulting actuation of the solenoids. The solenoid directs oil or air under pressure to the required end of the cylinder while at the same time exhausting oil to the reservoir or air to atmosphere from the other end of the cylinder.

The invention also provides an actuator apparatus for conveying and directing a fluid to a desired location comprising:
(a) a base element having a first hollow conduit formed there through, said first conduit having a first end and a second end, said first end adapted to be connected to a source of fluid;
(b) a rotatable body mounted to the base element, the rotatable body having a second hollow conduit formed through it, the second conduit having a first end and a second end, the first end of the second conduit communicating with the second end of the first hollow conduit, the rotatable body capable of rotation about a horizontal axis through an infinite arc; and
(c) a discharge elbow rotatably mounted to the rotatable body, the discharge elbow having a third hollow conduit formed through it, the third conduit having a first end and a second end, the first end of the third conduit communicating with the second end of the second conduit, the second end of the third conduit terminating at a discharge opening which directs discharge of the fluid in a desired direction, the discharge elbow being capable of rotation about a vertical axis through an arc of 280 degrees.

The invention which assists in rotating the cannon in a vertical and horizontal plan, is particularly helpful in powering water or liquid cannons, and specifically to liquid cannons used for such things as construction site dust suppression, cleaning of equipment, fire-fighting, or sluicing in which the ability to control the direction of flow of water from the monitor is required to be compact, robust and economic to construct.

The invention also provides, by the nature of the stainless steel and brass material used in its construction, for a very corrosion resistant and long lasting apparatus. These materials enable the actuator to successfully operate in corrosive and unfriendly environments where salt water or other atmospheres may prematurely fail other materials.

The invention will now be described, by way of example only and with reference to the drawings.

DETAILED DESCRIPTION

Figure 1:
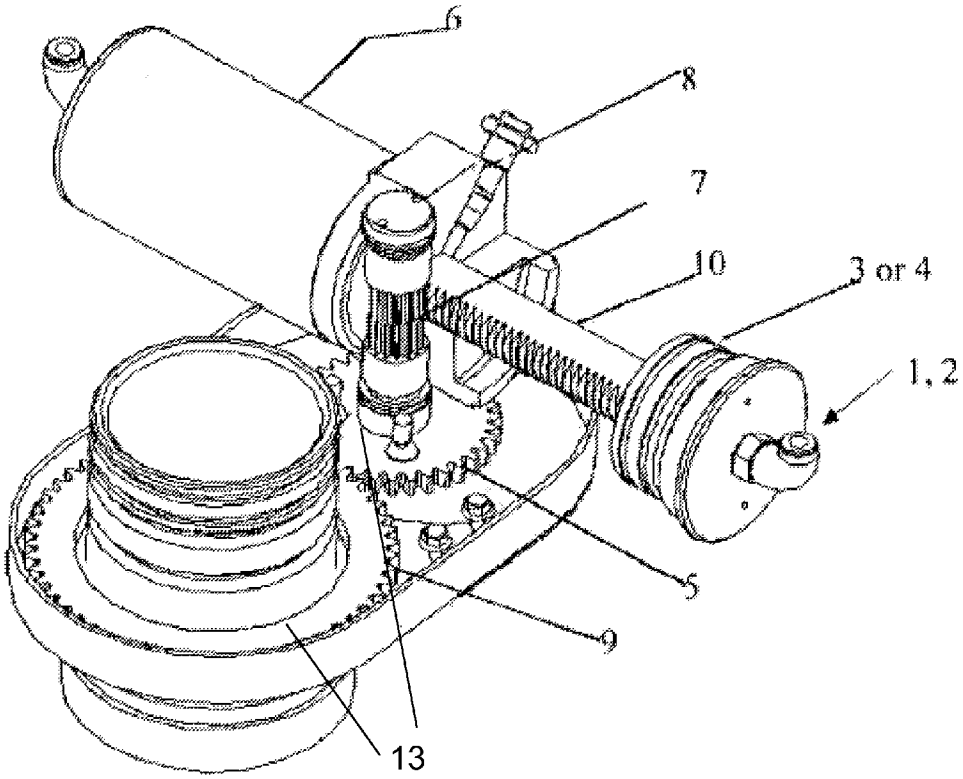
FIG. 1 is a cutaway view of the actuator mechanism. It shows the ports (1 or 2), the cylinder (6), piston (3 or 4), needle valve (8), rack (10) and pinion (7) and the driven (9) and driver gears (5). From this picture one can see the basic principal of our patent.

The actuator apparatus shown in FIG. 1 shows a cylinder (6), pistons (3 and 4), a needle valve (8), a rack (10) and pinion (7) and driven (9) and driver (5) gears, collectively a reduction set (13).

Figure 2:
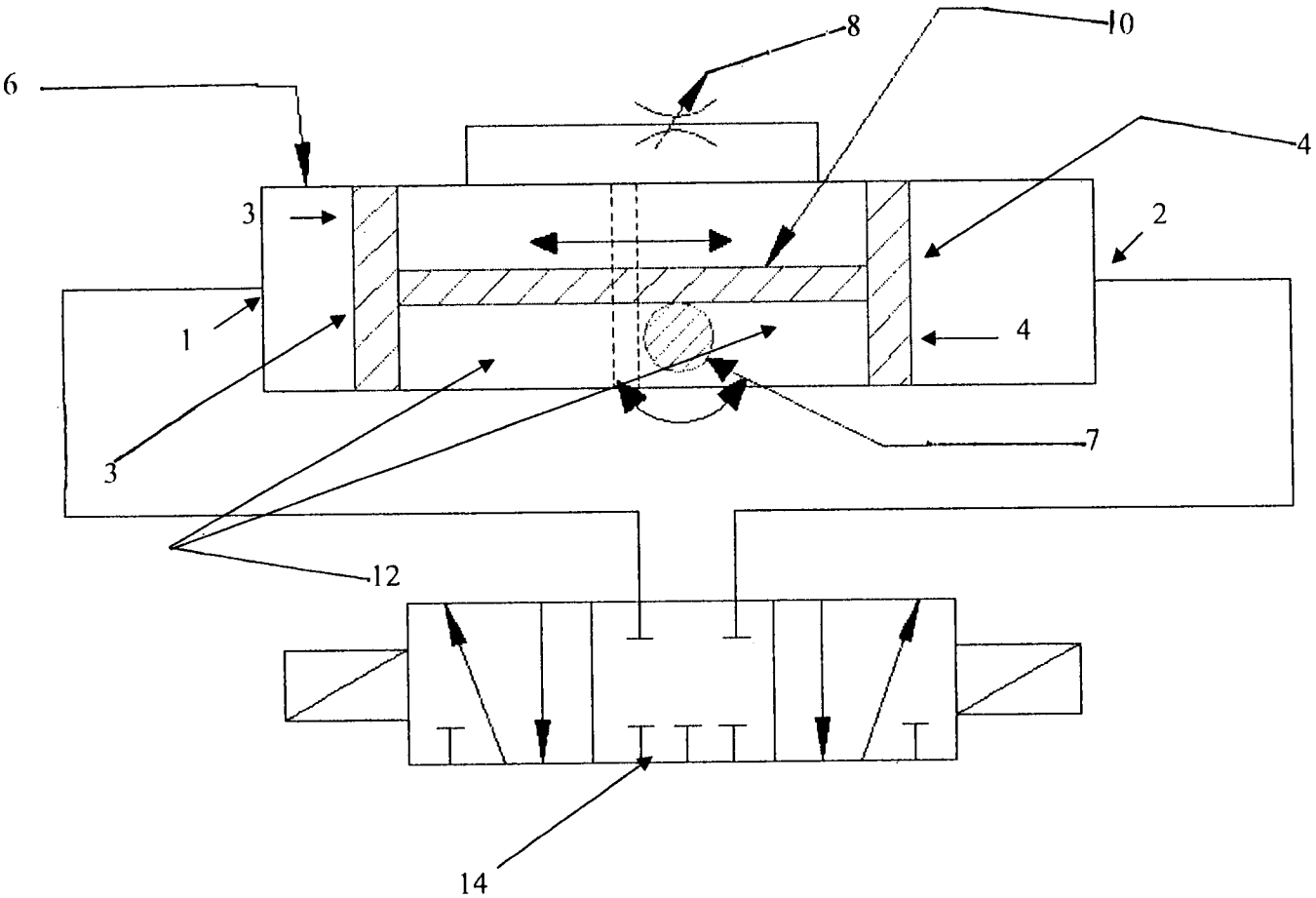
FIG. 2 is a schematic depiction of the hydraulic/pneumatic flows from the electronic control valve to the cylinder and the fluid effect of the needle valve.

In the schematic representation in FIG. 2 the control valve is pictured in the neutral position with no air or fluid flow to either end of the cylinder (6). If the solenoid control valve (14) is moved to the left then pressure air or fluid is directed to the right hand side of the cylinder (6) and air or fluid is exhausted from the left side of the cylinder (6) back through the solenoid control valve (14) to the reservoir if oil or atmosphere if air. FIG. 2 also shows the incompressible fluid chambers (12).

Figure 3:
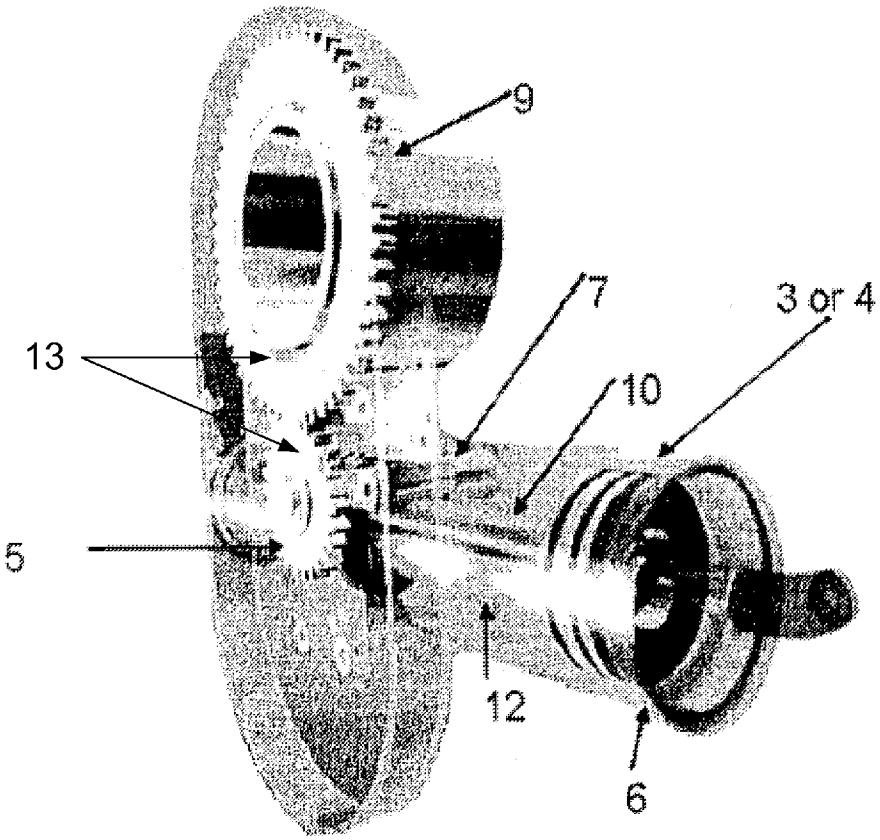
FIG. 3 is a see through pictorial view of the basic components of the invention.
Figure 4A:
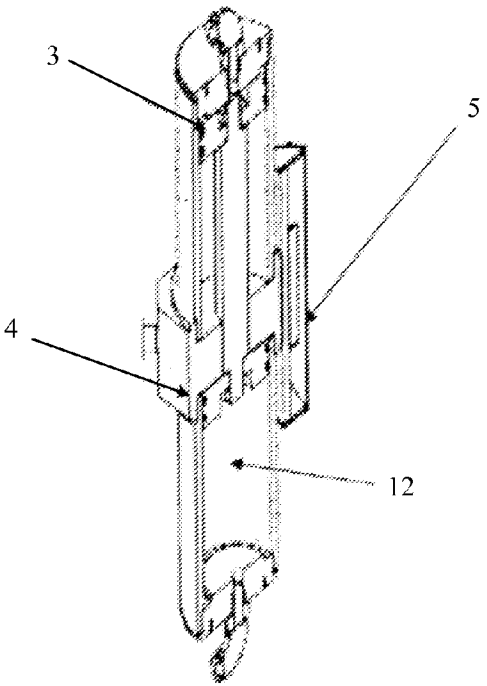
FIG. 4*a-e* shows the cylinders in more detail specifically the connection to the rotating assembly.
Figure 4B:
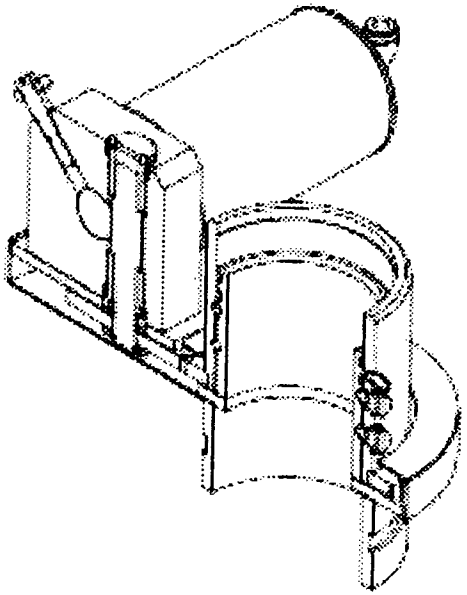
Figure 4C:
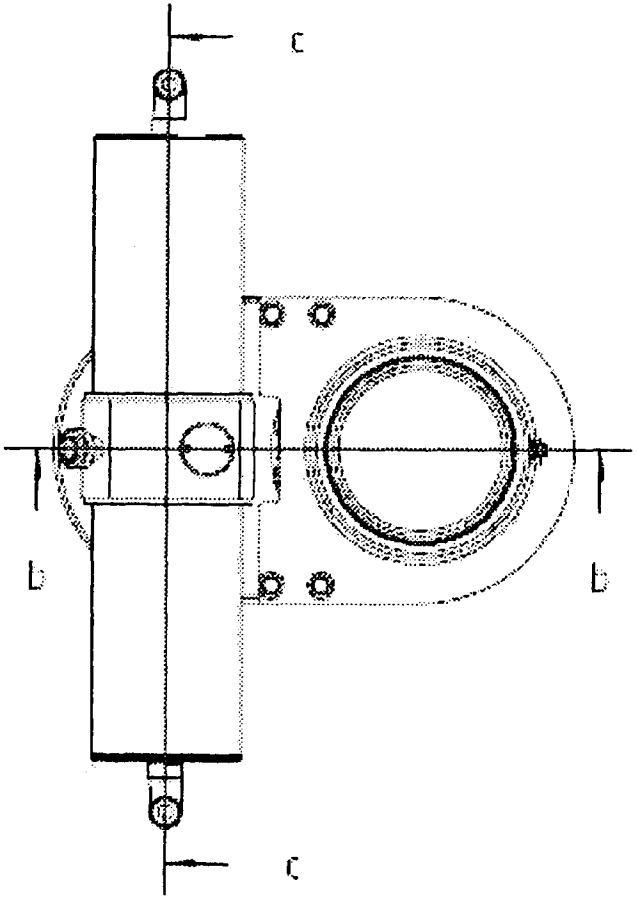
Figure 4D:
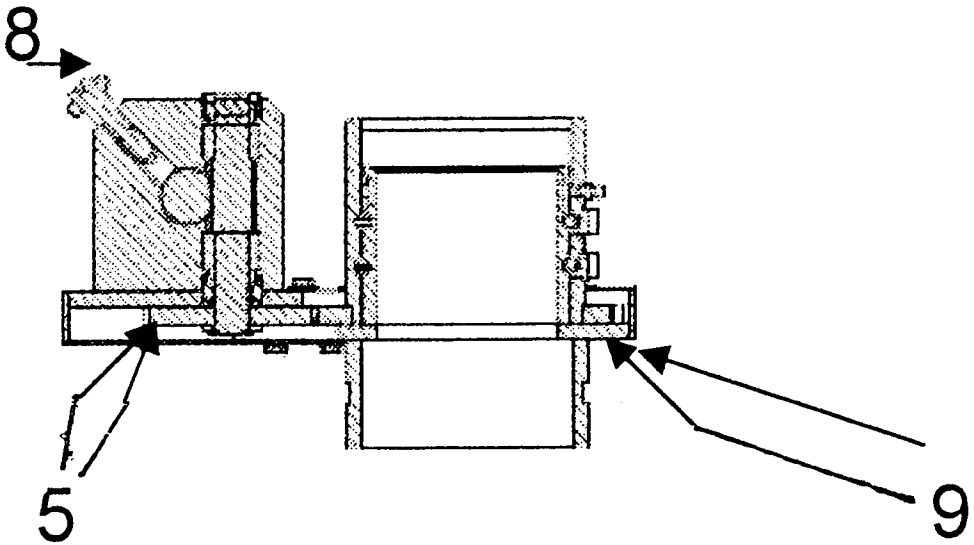
Figure 4E:
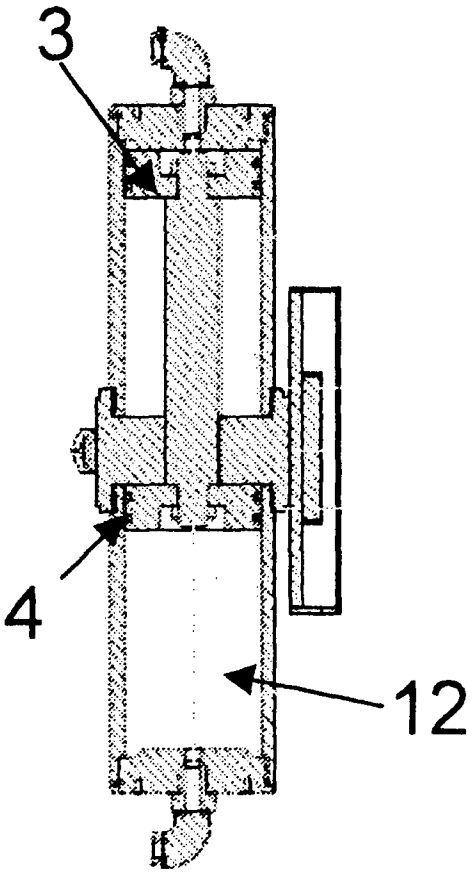

The basic components of the invention can most clearly be seen in FIG. 3. This diagram shows the cylinder (6), piston (3 or 4), rack (10), pinion (7), driven (9) and driver (5) gears, collectively a reduction set (13), and fluid chamber 12.

The cylinders are shown in more detail in FIG. 4 where especially visible are the cylinders and their connection to the rotating assembly. Pistons (3) and (4), fluid chamber (12), driver gear (5), needle valve (8) and driven gear (9) are shown.

Figure 5:
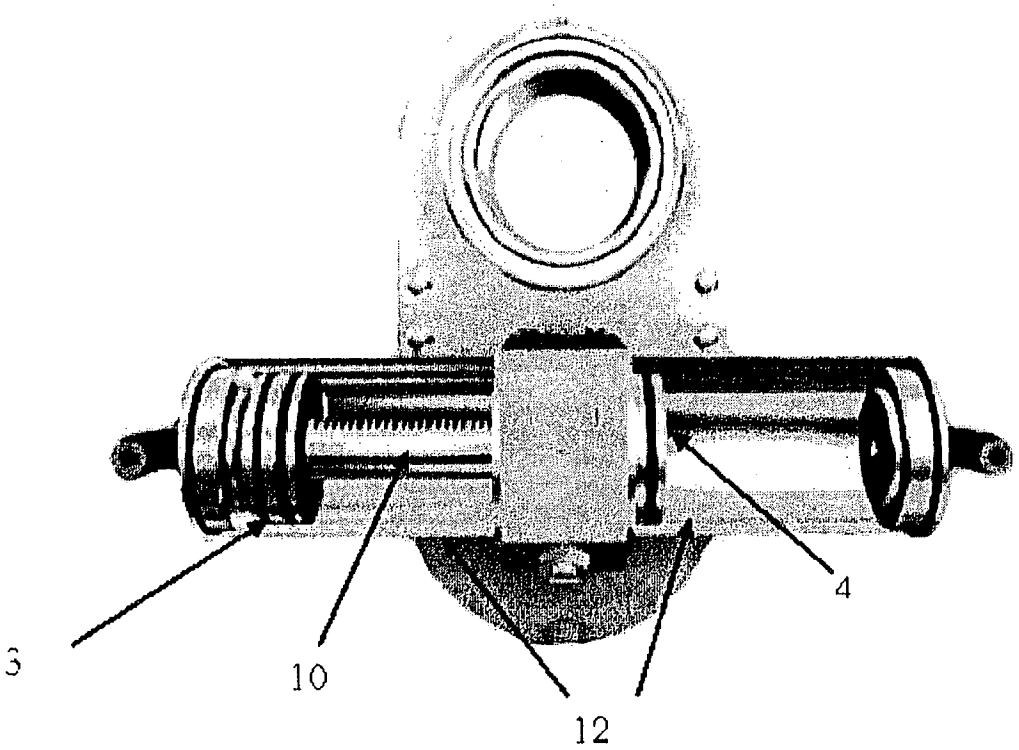
FIG. 5 shows the cylinder fully extended to the left.

A fully extended cylinder is shown in FIG. 5 pistons (3 and 4), the rack (10) and the fluid chamber (12) are shown.

Figure 6:
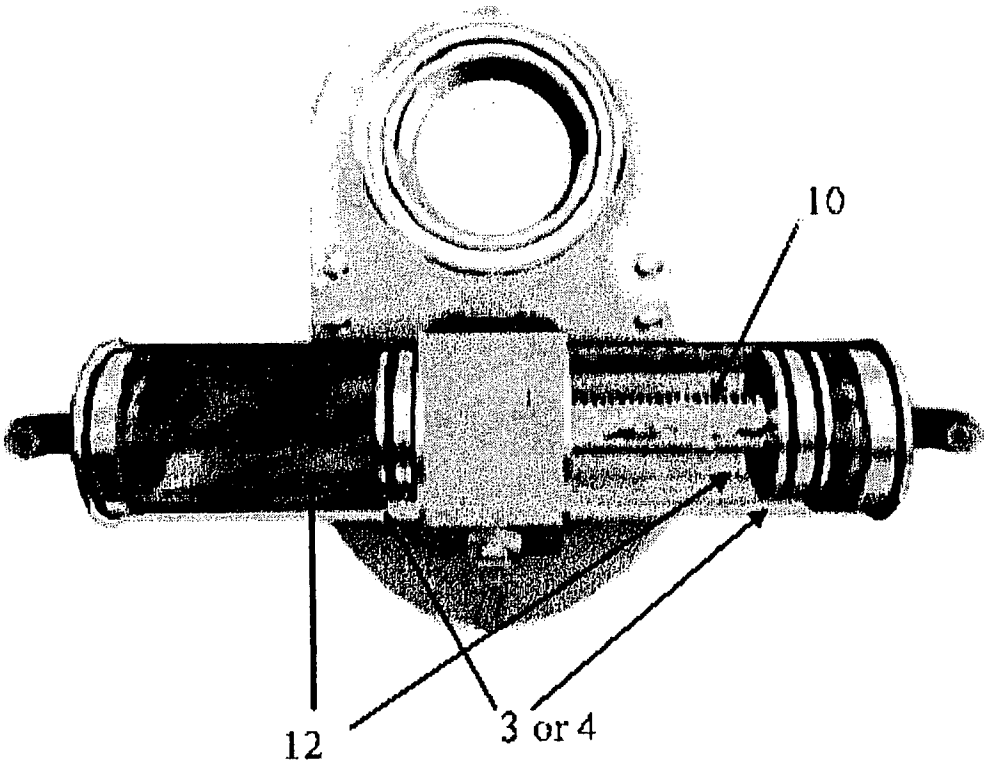
FIG. 6 shows the movement of the rack and piston with the associated transfer of fluid from the inside of the piston on the left to the inside of the piston in the right.

FIG. 6 shows the movement of the rack and piston to the right with the associated transfer of fluid from the inside of the piston on the left to the inside of the piston in the right. Also shown is the fluid chamber (12) and the needle valve (8).

Figure 7:
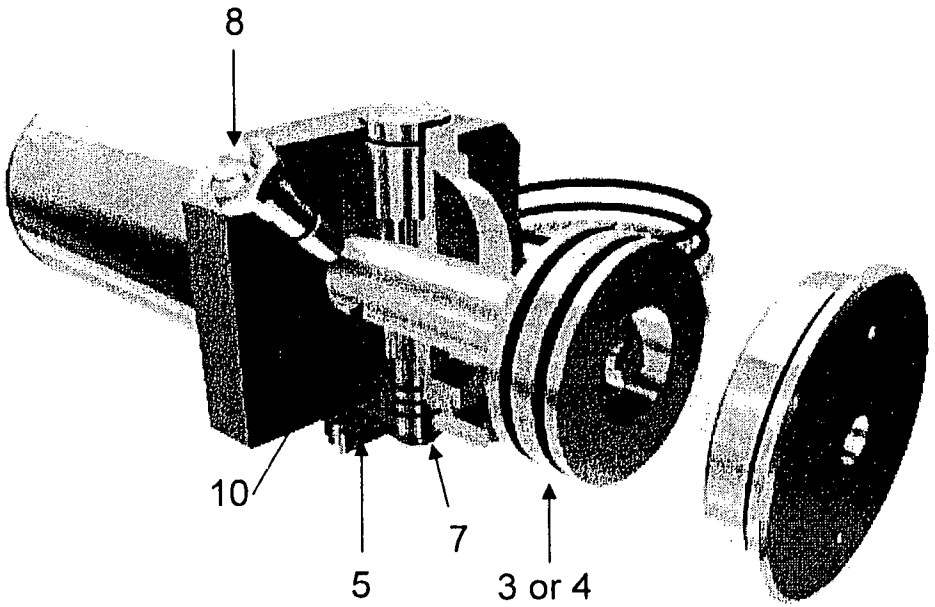
FIG. 7 shows internal view of one side of the cylinder.

FIG. 7 shows an internal view of one side of cylinder; piston (3 or 4), pinion (7), needle valve (8), rack (10).

Figure 8:
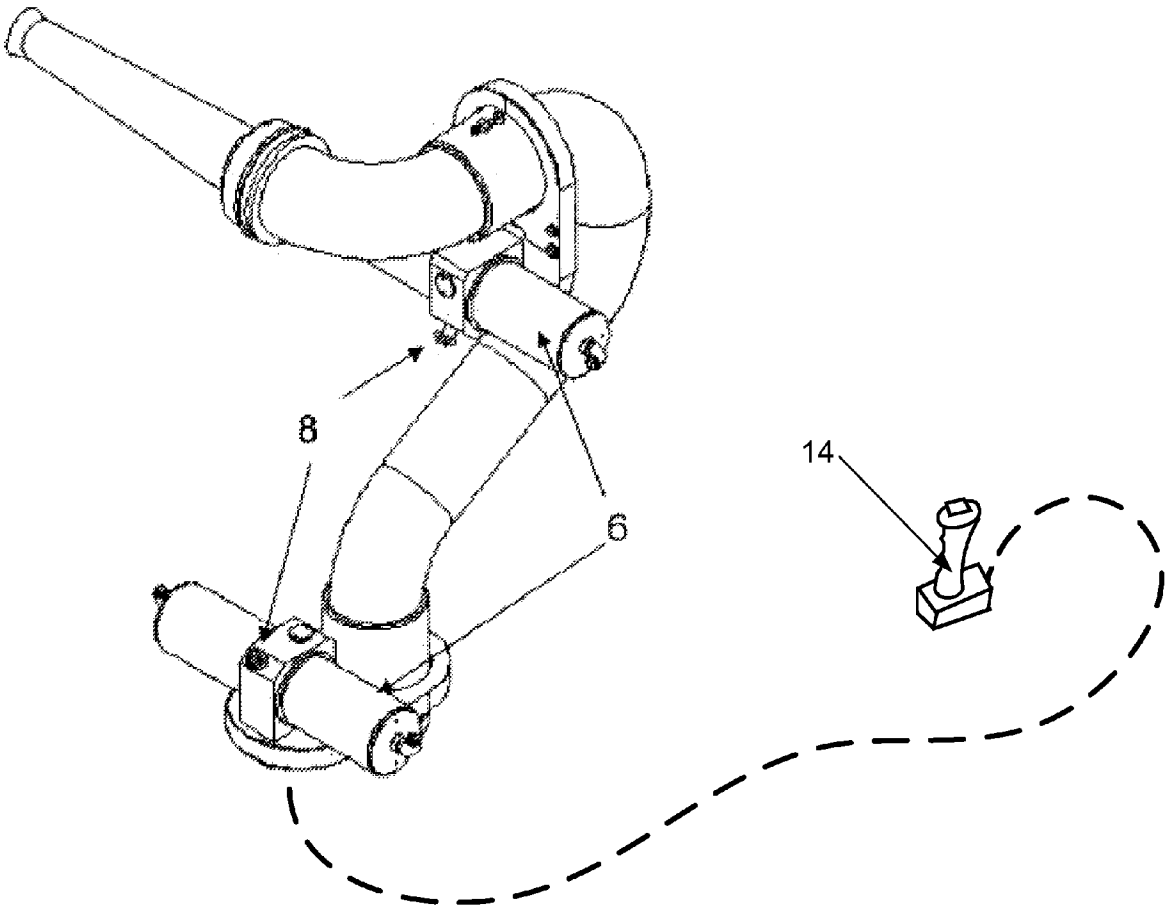
FIG. 8 shows two actuators fitted to a typical fluid cannon requiring both vertical and horizontal rotating movement.

FIG. 8 shows how two actuator mechanisms can be fitted to a typical fluid cannon that requires both vertical and horizontal movement. In the diagram, the needle valve (8), the cylinders (6) and the electronic joystick (14) can be seen.

The actuator as described can perform a variety of actuating functions according to need but in this description the use of the actuator relating to the rotating action (vertical and horizontal) of a fluid cannon on a water truck is described. It will be appreciated however that the actuator apparatus described may be used in a number of situations, where speed control of vertical and horizontal movement is required, along with protection from vibration and contamination from the environment.

The actuator may be powered by hydraulic oil under pressure or by compressed air (pneumatic).

An operator of the actuator apparatus switches the desired electrical switch in the control centre. This electrical switch in turn activates the desired solenoid to direct air or fluid to the required cylinder (6) (an electric over air or electric over fluid solonoid). The cylinder (6) will either operate the slew or the elevation cylinders. Either hydraulic oil pressure (from an independent oil pump) or air pressure (from an independent air compressor) will then be directed to the specified actuator.

Hydraulic oil or air enters the cylinder (6) via an port (1 or 2), dependant on which way the actuator is to move. The pressurised air or fluid acts against the surface of the piston (3 or 4) and moves the piston and therefore the rack (10) within the cylinder (6) to the left or right. The rack (10) has teeth which are meshed with the teeth of the pinion (7). The movement of the rack (10) to the left or right results in the pinion rotating either clockwise (if the rack (10) moves from left to right) or anticlockwise (if the rack (10) moves from right to left). The axial movement of the pistons (3 and 4) and the rack (10) are thereby transformed into rotary movement using the meshing and imparting motion of the rack (10) and pinion (7) gears.

Concurrently, the needle valve (8), which is positioned in the fluid connecting passage between the inner areas behind each of the pistons, meters the bypass of the fluid from the inner side of the piston on one side to the inner side of the piston from the other side. This metering effect results in a dampening action of the piston's movement. This is one method for controlling piston speed and giving a steady and predictable feel to the required movement. The extent of travel for the rack and therefore the rotation of the pinion is determined by either the operator and the joystick (releasing the joystick back to the neutral position) or when the piston contacts either end of the cylinder.

With reference to FIG. 1, it can be seen that the rotary movement of the pinion shaft is transferred to the connected driver gear (5) (fixed to the shaft). The driver gear (5) then drives the driven gear (9). The driven gear (9) is directly connected to the output member of the rotation device and thus transfers the rotation to this member. In the case of the fluid cannon, the output member is directly connected to the rotation of the slew (horizontal) motion of the cannon or the elevation (vertical) motion of the cannon and the rotation of these parts is determined by the action of the whole actuating mechanism.

The invention's basic components and their relativity to each other is most easily seen in FIG. 3. If the motion flow is followed from the pistons to the rack and its teeth meshed with the pinion shaft, this in turn rotates the smaller driver gear which finally rotates the larger driven gear.

Although other advantages may be found and realized and various modifications may be suggested by those versed in the art, it is understood that the present invention is not to be limited to the details given above, but rather may be modified within the scope of the specification.

The actuating mechanism according to the invention provides a number of advantages over the known mechanism. For example, the design and build is extremely simple and yet very robust. It is ideally suited to extreme applications and will tolerate very dirty environments and is not vibration sensitive. It is likewise not sensitive to the effects of water or contamination.

The design concept allows for an almost infinite variation of speed, control and force applied from the actuating cylinder. By changing the size of the rack and pinion teeth, or the number of the driving and driven teeth, the speed of rotating member can be varied. By changing the size of the piston the turning force can be further changed and a further torque multiplication on the rotating member can occur; further if the pistons are unequal sizes on each side of the actuating cylinder, different forces can be applied in differing directions. This allows for differential forces to be applied for different applications requiring this.

The cylinder has an integral needle valve which limits the rate at which the fluid on the inside of one piston is able to transfer to the other side of the cylinder. This effectively creates a variable damper which enables the actuator to operate faster or slower simply by the adjustment of an external needle valve.

The actuator is remotely controlled through solenoids activated by the operator using electronic switches. This allows remote control of the actuator while using air or fluid to activate it, this allows for the unit to be used in extreme conditions and in circumstances where primarily electrical systems are likely to fail.

Whilst the invention has been described with reference to a particular embodiment, it will be appreciated that numerous modifications and improvements may be made to the embodiment without departing from the scope of the specification as set out in the description.

For example, the specific embodiment described relates to a fluid cannon, more particularly a water cannon. It is envisaged however that the invention could be applied to many mechanical devices requiring robust actuating mechanisms capable of remote control and able to operate in wet, dirty and harsh environments, examples of applications would be;

Remote rotation and actuation of small armament;

Remote control of some agricultural components i.e., combine harvester auger arm movement;

The controlled raising and lowering of front or rear mounted specialist implements on specialist vehicles i.e., mobile spray equipment or horticultural machinery;

The control and actuation of marine equipment i.e., winches where corrosion and salt water are problematic;

Remote operation of gate or fluid valves in harsh environments.

INDUSTRIAL APPLICABILITY

The invention will find a wide range of industrial applications in cannons where a robust actuating mechanism is required. This may be in, for example, armament vehicles, agricultural mechanisms, and marine equipment.

The invention claimed is:

1. A system for manipulating a fluid cannon, the system comprising:

(a) a base element comprising a first hollow conduit formed therethrough, said first conduit further comprising a first end and a second end, said first end adapted to be connected to a source of fluid;

(b) a rotatable body mounted to the base element, the rotatable body comprising a second hollow conduit formed through it, the second conduit further comprising a first end and a second end, the first end of the second conduit communicating with the second end of the first hollow conduit, the rotatable body capable of rotation about a horizontal axis through an infinite arc;

(c) a discharge elbow rotatably mounted to the rotatable body, the discharge elbow comprising a third hollow conduit formed through it, the third conduit further comprising a first end and a second end, the first end of the third conduit communicating with the second end of the second conduit to form a continuous flow path from the first hollow conduit to the third hollow conduit, the second end of the third conduit terminating at a discharge opening which directs discharge of the fluid in a desired direction;

(d) a horizontal drive apparatus operably engaged with the rotatable body, the horizontal drive apparatus being operable to rotate the rotatable body in response to control signals, the horizontal drive apparatus comprising a first inlet port for receiving hydraulic oil or air, a first piston located within a first cylinder in communication with the first inlet port, a first rack having a plurality of teeth, the first rack being in operative engagement with the first piston, the horizontal drive apparatus further comprising a first pinion having a plurality of teeth that mesh with the teeth of the first rack so that linear movement of the first piston, as a result of pressure from hydraulic oil or air via the first inlet port, translates to linear movement of the first rack and rotational movement of the first pinion, and wherein the first pinion is in operable engagement with the rotatable body for rotating the rotatable body about a horizontal plane when the first pinion is rotated;

(e) a vertical drive apparatus operably engaged with the discharge elbow, the vertical drive apparatus comprising a second inlet port for receiving hydraulic oil or air, a second piston located within a second cylinder in communication with the second inlet port, a second rack having a plurality of teeth, the second rack being in operative engagement with the second piston, the vertical drive apparatus further comprising a second pinion having a plurality of teeth that mesh with the teeth of the second rack so that linear movement of the second piston, as a result of pressure from hydraulic oil or air via the second inlet port, translates to linear movement of the second rack and rotational movement of the second pinion, and wherein the second pinion is in operable engagement with the discharge elbow for rotating the discharge elbow about a vertical plane when the second pinion is rotated; and (f) a first needle valve in fluid communication with the first cylinder to meter fluid on either side of the first piston to dampen a first piston movement.

2. The system according to claim 1, further comprising a first actuator apparatus including a first drive train that transforms axial movement into a rotary output.

3. The system according to claim 2 further comprising a second actuator apparatus including a second drive train that transforms axial movement into a rotary output.

4. The system of claim 2, wherein the first drive train comprises a rack and pinion mechanism and a cylinder and reduction set.

5. The system according to claim 4, wherein the cylinder and reduction set is made from steel and brass components.

6. The system accordingly to claim 4 or 5, wherein the cannon includes a base attached to a fixed surface and the cannon rotates horizontally on the base.

7. The system according to claim 6, wherein the cannon is further configured to rotate vertically.

8. The system according to claim 7, further comprising a first tubular body and a second tubular body, wherein the first tubular body is configured to bend at an angle of 180 degrees and is affixed to the second tubular body which rotates vertically to thus control the direction of aim of a fluid from the cannon.

9. The system according to claim 8, in which the horizontal and vertical rotations of the cannon are powered either hydraulically or pneumatically via adjustable flow cylinders through a use of the first rack and first pinion or the second rack and second pinion.

10. The system according to claim 9, wherein the first actuator apparatus is operable by an electronic joystick which actuates a solenoid valve to direct oil or air to at least one of the adjustable flow cylinders to provide the rotary output.

11. The system according to claim 2 or 4, wherein the first actuator apparatus is pneumatically or hydraulically powered.

12. The system according to claim 2, 4 or 5, wherein the first actuator apparatus includes an integral control valve to allow for flow adjustment of a fluid from the cannon.

13. The system according to claim 2, wherein at least one of the horizontal drive apparatus or the vertical drive apparatus includes the first actuator apparatus.

14. The system of claim 1, wherein the discharge elbow is capable of rotation about a horizontal axis through an arc of 280 degrees.

15. The system according to claim 1 or 14, in which the horizontal drive apparatus and the vertical drive apparatus are pneumatically or hydraulically powered.

16. The system according to claim 1, wherein the first cylinder, the second cylinder, or both the first and the second cylinders comprise corrosion resistant stainless steel and brass components.

17. The system according to claim 1, in which the the vertical drive apparatus further includes an integral control valve to allow for flow adjustment of the fluid from the discharge opening.

18. The system according to claim 17, wherein the horizontal and vertical rotations of the rotatable body and discharge elbow respectively are powered hydraulically.

19. The system according to claim 18, operable by an electric joystick which actuates a solenoid valve to direct oil to the first piston, the second piston, or both the first and the second piston to provide the rotational movement of the first or second pinion.

20. The system according to claim 17, wherein the horizontal and vertical rotations of the rotatable body and discharge elbow respectively are powered pneumatically.

21. The system according to claim 20, operable by an electric joystick which actuates a solenoid valve to direct air to the first piston, the second piston, or both the first and the second piston to provide the rotational movement of the first or second pinion.

22. The system according to claim 17, further comprising a second needle valve in fluid communication with the second cylinder to meter fluid on either side of the piston to dampen a second piston movement.

23. The system according to claim 1, wherein the source of fluid is water.

* * * * *